United States Patent [19]

Skalleberg

[11] Patent Number: 4,616,469

[45] Date of Patent: Oct. 14, 1986

[54] METHOD FOR PRODUCING A PACKAGE

[75] Inventor: Öystein Skalleberg, Järfälla, Sweden

[73] Assignee: Skaltek AB, Kungsangen, Sweden

[21] Appl. No.: 732,904

[22] PCT Filed: Apr. 24, 1981

[86] PCT No.: PCT/SE81/00124

§ 371 Date: Jan. 20, 1982

§ 102(e) Date: Jan. 20, 1982

[87] PCT Pub. No.: WO81/03319

PCT Pub. Date: Nov. 26, 1981

Related U.S. Application Data

[63] Continuation of Ser. No. 346,069, Jan. 20, 1982, abandoned.

[30] Foreign Application Priority Data

May 21, 1980 [SE] Sweden ..... 8003826

[51] Int. Cl.[4] ..... B65B 61/00

[52] U.S. Cl. ..... 53/410; 53/430; 53/456; 206/395; 206/397; 206/409

[58] Field of Search ..... 53/204, 397, 409, 410, 53/430, 456, 581; 206/389, 395, 396, 397, 409, 408; 242/105, 137, 137.1, 138; 493/954

[56] References Cited

U.S. PATENT DOCUMENTS

| | | | |
|---|---|---|---|
| 1,691,995 | 11/1980 | Saulter | 206/408 X |
| 1,775,228 | 9/1930 | Valentine | 206/397 |
| 2,101,355 | 12/1937 | Wonder | 206/396 |
| 2,475,399 | 7/1949 | Nelson | 53/409 X |
| 2,527,401 | 10/1950 | Daoust | 242/118.8 |
| 2,794,546 | 6/1957 | Miller | 206/397 |
| 3,086,309 | 4/1963 | Katz | 206/397 X |
| 3,307,802 | 3/1967 | David | 242/118.8 |
| 3,856,141 | 12/1974 | Reed | 206/407 |
| 4,168,778 | 9/1979 | Buxton | 206/397 X |

FOREIGN PATENT DOCUMENTS

| | | | |
|---|---|---|---|
| 1185692 | 4/1959 | France | 206/389 |
| 517564 | 2/1940 | United Kingdom | 206/389 |

*Primary Examiner*—Robert L. Spruill
*Assistant Examiner*—Donald R. Studebaker
*Attorney, Agent, or Firm*—Carothers & Carothers

[57] ABSTRACT

A method for producing a package to receive a ring (7) of reeled wire, tube or the like cut to a predetermined length, especially an electrical line (8). The ring (7) is introduced between two substantially square panels of rigid material, e.g. cardboard or the like, with the center axis of the ring running perpendicular to the panels. A substantially tubular rigid means (10) is after introduced through both panels and the center opening of the ring (7) and is thereafter locked in the introduced position in relation to the ring (7) well as the panels. The package can be used as a reel by removing a protective shell of the package. As an alternative said tubular rigid means can be removed, whereby the line or the like is removed from the center of the package.

6 Claims, 9 Drawing Figures

METHOD FOR PRODUCING A PACKAGE

This is a continuation of co-pending application Ser. No. 346,069, filed Jan. 20, 1982, and now abandoned.

The present invention relates to a method for producing a package for receiving a ring of reeled wire, tube or the like which is cut to a predetermined length, especially an electrical line, in which the ring is introduced between two substantially square panels of rigid material, e.g. cardboard or the like with the center axis of the ring running perpendicular to the panels.

Electrical lines with slender dimensions are often distributed in the form of rings with a predetermined number of windings without a reel. The reason for this is that great demands are made upon the strengths of the reel so that it can be gripped in a modern reel machine, which in turn leads to costs for the reels which become too high in view of the fact that they normally are thrown away after the line is unreeled. Further, it takes less time to reel on a reeling machine if the reel does not need to be exchanged after every reeling process. Moreover, prefabricated empty reels are bulky and, therefore, take up a great portion of the space of a reeling machine.

Such line rings are often packed simply in plastic bags. A plastic bag is a simple and cheap package which, however, is not adapted for keeping the line ring in order during use on a place of work. Accordingly, such line rings also have been packed in cartons, in which a hole is made to detach the line from the center of the ring. Accordingly the line is turned, which is not to be tolerated at certain types of lines.

To prevent turning of the line when unreeling, it is accordingly necessary to unreel the line in the tangential direction from the outer circumference of the ring. To accomplish this it is necessary that the line ring is arranged on a reel with flanges which keep the line ring in order during unreeling.

It is an object of the present invention to provide a simple and cheap reel to receive a ring reeled electrical line or other cord formed goods.

This object will be achieved according to this invention by a package in which a substantially tubular at least in the axial direction, rigid means 10 is introduced through both panels and the center opening of the ring 7 after being inserted between the panels, and is thereafter locked in the introduced position in relation to the ring 7 well as the panels.

Other objects of the invention will be apparent from the following detailed description of the drawings.

Figure 1:
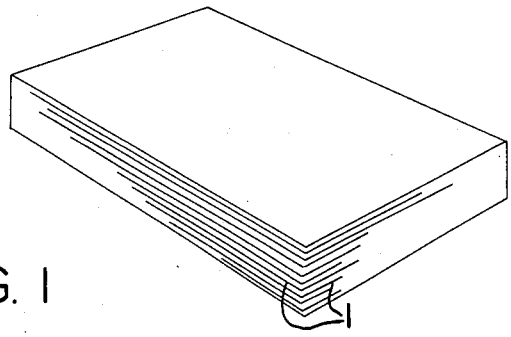
FIG. 1 is a perspective view of a stack of sheet formed blanks for use in the manufacture of a reel according to the method of the invention.

FIG. 1 shows a number of stacked sheets 1 of rigid material, e.g. cardboard or the like. In a first step, a blank is produced according to the present invention to form a carton according to the appearance of FIG. 2. The carton blank shown in FIG. 2, which blank is not an object of the invention, presents fold lines 2, perforation lines 3, cuts 4 and recesses or openings 5, which all make it possible to provide a carton of the appearance of FIGS. 4 and 5. FIG. 3 shows the initial stage of the folding of the carton.

Figure 4:
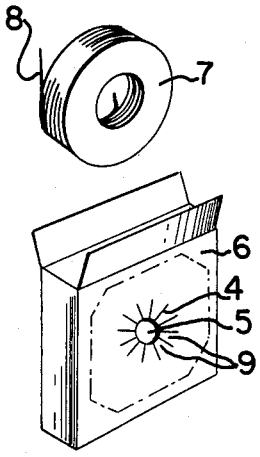
FIG. 4 is a perspective view of a finished carton and a ring made of a predetermined number of windings of an electrical line etc., said carton being adapted to receive said ring.
Figure 5:
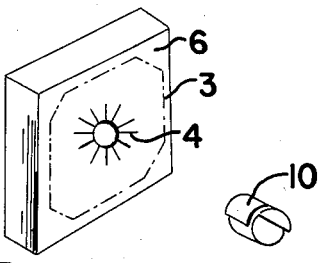
FIG. 5 is a perspective view showing the closed carton in which a line ring is enclosed, and a non-mounted hub means.

In FIG. 4 the upwardly open but otherwise already folded carton 6 is shown. Said carton is now ready to receive a ring 7 with a predetermined number of windings of electrical line 8 reeled thereon. Radially extending cuts 4 form substantially triangular flaps 9 which are extended inwardly toward the centre of respective carton sides and beyond the inner circumference ridge of the ring 7, which is to be introduced in the carton 6. After the ring 7 is introduced in the carton 6 the flaps 9 are folded into the center opening of ring 7 from the ouside the respective carton sides. Accordingly, the flaps 9 will extend substantially along the center axis of the line ring.

Figure 8:
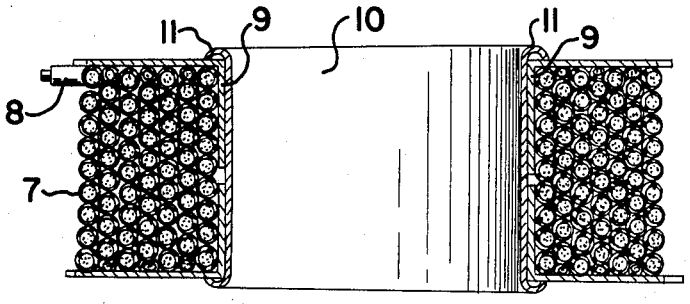
FIG. 8 is a sectional view through the line ring and the reel of FIG. 7.

In the opening formed by the flaps 9 folded inwardly from both sides, in the preferred embodiment, a substantially tubular expandable member is inserted in the axial direction in the form of rigid hub means 10 which is locked in the introduced position in relation to ring 7 as well as the carton sides by expanding the hub means. At this moment, the inwardly folded flaps 9 will be clamped between the outer side of the tubular means 10 and the inner most windings of the ring 7. To lock the hub means 10 evenly against the respective carton side the sides of the hub means 10 are provided with flanges 11 at both ends, as is best seen in FIG. 8.

Figure 6:
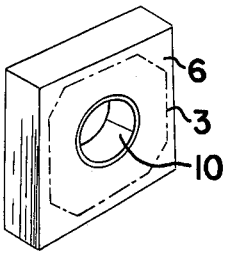
FIG. 6 is a perspective view showing the finished carton with the mounted hub means.

The package shown in FIG. 6 can easily be stacked and, hence, it is well adapted for long transports.

Figure 7:
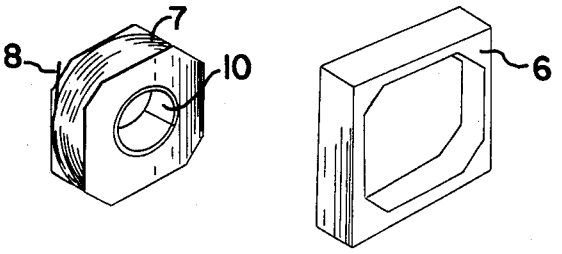
FIG. 7 is a perspective view showing the line ring on a reel taken away from the carton.

When such a package arrives to a consumer he will simply break up the package along the perforation lines 3, obtaining both parts shown in FIG. 7. In this case, the right part consists only of a protective shell for the left part which comprises the line ring 7 mounted on a reel with flanges 9, whereby unreeling of the line 8 from said reel is accomplished in the tangential direction.

Figure 9:
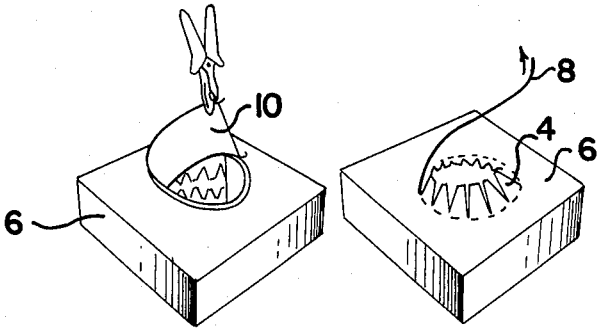
FIG. 9 is a schematical view showing the two steps of using the carton to detach the line from the center of the carton.

As an alternative the package can be used as shown in FIG. 9. In this case the hub means is removed by means of a pair of nippers of the like, whereafter the line can be removed from the centre of the carton.

Figure 2:
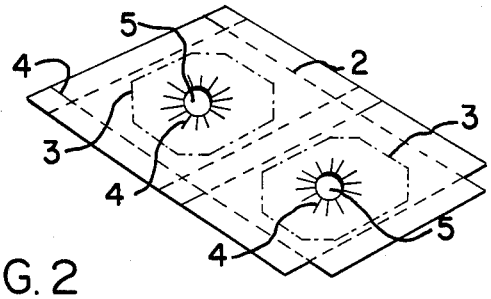
FIG. 2 is a perspective view of a blank according to FIG. 1, said blank being provided with fold lines, perforation lines and cuts.
Figure 3:
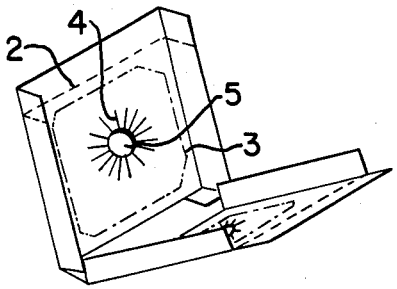
FIG. 3 is a perspective view of the blank of FIGS. 1 and 2 showing the folding thereof to a carton.

Of course, both side flanges of the reel do not need to be provided as shown in the drawings starting with the carton blank shown in FIG. 2, but can be provided by means of two separate substantially square panels of rigid material, between which the ring is introduced. In this situation, both panels must be provided with the flaps 9 in the same manner as the carton blank shown.

It is also possible to eliminate the flaps and provide the panels, or as an alternative the carton blank with openings of a diameter substantially corresponding to the inner diameter of the ring 7. Of course, the hub means 10 does not need to be expandable, but can present a somewhat greater outer diameter than the inner diameter of the ring 7 and the diameter of said openings. When said hub means is introduced it will be locked by friction against the innermost windings of the ring 7 as well as the inner ridge of the openings in the panels.

The above disclosure is for illustrative purposes only, and not for purposes of limitation of the scope of the invention.

I claim:

1. In the packaging of an elongated article, especially a length of electrical cable (8), wherein the elongated article is provided in a coiled or ring form (7) of a given outer radius and having a center opening therein, a method of packaging such elongated article to permit alternative modes of dispensing the elongated article comprising:

(a) providing a pair of substantially square, flat panels of selfsupporting rigidity;

(b) providing each said panel with a line of perforation continuously encompassing a portion of the respective panel having a radius at least as great as said given radius;

(c) orienting said panels in spaced, substantially parallel relationship and introducing a ring (7) of such elongated article, without a central core support in its center opening, between said parallel panels with the center axis of the ring (7) substantially perpendicular to said panels;

(d) subsequently introducing a substantially tubular means (10) through said encompassed portion of each of said parallel panels and the intervening center opening of the ring (7) disposed therebetween; and (e) releasably securing said tubular means (10) in the introduced position in relation to the ring (7) and said parallel panels to provide a central core support for supporting the ring (7) with respect to the parallel panels whereby the contents of the ring (7) may be subsequently removed from the ring either by breaking out the portions of said panels within the confines of said perforations to form a reel on which the ring (7) is coiled for access to the outermost turns of the ring (7) or by removing said tubular means from the ring (7) and said panels for access to the innermost turns of the ring (7).

2. The method according to claim 1, including the additional step of connecting said pair of panels together along respective adjacent edge portions thereof to form a box-like enclosure for containing the ring (7).

3. The method according to claim 2, wherein each panel is provided with a central opening before the ring (7) is introduced between said panels, the diameter of said openings substantially corresponding to the inner diameter of the ring center opening and positioned for axial alignment with a ring center opening when a ring is introduced between said parallel panels.

4. The method according to claim 3, wherein the panels are provided with a predetermined number of centrally placed substantially triangular flaps (9) positioned about the perimeter of said central opening before the ring (7) is introduced between the parallel panels, said flaps extending inwardly toward the center of the respective central opening beyond the level of the inner circumference of the ring, said flaps being folded into the center opening of the ring from the outer side of the respective panels after the ring is introduced between the panels and before said tubular means (10) is introduced therein.

5. The method according to claim 4 wherein the tubular means (10) is locked in the introduced position in relation to the ring as well as the panels by providing said tubular means with circumferentially expanding tendencies in such a way that it expands and clamps against the ring as well as against the panels.

6. The method according to claim 4 wherein said tubular means (10) in the introduced position is flared outwardly at its ends so that the thereby formed flanges (11) are abutting against the outer side of the respective panels.

* * * * *